US009476423B2

(12) United States Patent
Birch et al.

(10) Patent No.: US 9,476,423 B2
(45) Date of Patent: Oct. 25, 2016

(54) ROOTS PUMP CONNECTION CHANNELS SEPARATING ADJACENT PUMP STAGES

(75) Inventors: Peter Birch, Sussex (DE); Thomas Dreifert, Kerpen (DE); Robert Jenkins, Sussex (DE); Clive Tunna, Sussex (DE)

(73) Assignee: OERLIKON LEYBOLD VACCUM GMBH, Cologne (DE)

( * ) Notice: Subject to any disclaimer, the term of this patent is extended or adjusted under 35 U.S.C. 154(b) by 0 days.

(21) Appl. No.: 14/238,611

(22) PCT Filed: Aug. 7, 2012

(86) PCT No.: PCT/EP2012/065406
§ 371 (c)(1),
(2), (4) Date: Feb. 12, 2014

(87) PCT Pub. No.: WO2013/023954
PCT Pub. Date: Feb. 21, 2013

(65) Prior Publication Data

US 2014/0205483 A1 Jul. 24, 2014

(30) Foreign Application Priority Data

Aug. 17, 2011 (DE) ..... 20 2011 104 491 U

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/12*** | (2006.01) |
| ***F04C 23/00*** | (2006.01) |
| ***F04C 25/02*** | (2006.01) |
| ***F04C 18/08*** | (2006.01) |

(52) U.S. Cl.
CPC ..... *F04C 18/126* (2013.01); *F04C 18/086* (2013.01); *F04C 23/001* (2013.01); *F04C 23/003* (2013.01); *F04C 25/02* (2013.01)

(58) Field of Classification Search
CPC .... F04C 18/084; F04C 18/16; F04C 18/126; F04C 11/001; F04C 23/001; F04C 23/003; F04C 23/002
USPC ..... 418/5, 9, 201.1, 206.1
See application file for complete search history.

(56) References Cited

U.S. PATENT DOCUMENTS 4,639,199 A 1/1987 Frings et al.
4,789,314 A * 12/1988 Higuchi et al. ..... 418/9

(Continued)

FOREIGN PATENT DOCUMENTS

AT 140808 2/1935
CN 101985938 A 3/2011

(Continued)

OTHER PUBLICATIONS

International Search Report dated Nov. 4, 2013 for PCT application No. PCT/EP2012/065406.

(Continued)

*Primary Examiner* — Theresa Trieu
(74) *Attorney, Agent, or Firm* — Ohlandt, Greeley, Ruggiero & Perle, LLP

(57) ABSTRACT

A Roots pump comprises a plurality of multi-toothed rotary pumps, each forming a pump stage, and connection channels connecting respective adjacent pump stages. The invention provides that the connection channels are arranged in partitioning walls separating the adjacent pump stages.

10 Claims, 5 Drawing Sheets

(56) References Cited

U.S. PATENT DOCUMENTS

| | | | | |
|---|---|---|---|---|
| 5,118,251 | A | 6/1992 | Saulgeot | |
| 7,278,839 | B2 * | 10/2007 | Liu et al. | 418/9 |
| 7,491,041 | B2 | 2/2009 | Imai | |
| 2005/0089424 | A1 | 4/2005 | Liu et al. | |
| 2009/0246040 | A1 | 10/2009 | Tanigawa | |
| 2010/0158728 | A1 | 6/2010 | Schofield et al. | |

FOREIGN PATENT DOCUMENTS

| | | | |
|---|---|---|---|
| CN | 102146919 | A | 8/2011 |
| DE | 3244099 | A1 | 6/1983 |
| DE | 3312117 | A1 | 10/1984 |
| DE | 3617889 | | 12/1986 |
| DE | 4038704 | A1 | 6/1994 |
| DE | 69008683 | T2 | 8/1994 |
| DE | 29906654 | U1 | 7/1999 |
| EP | 1256720 | A2 | 11/2002 |
| EP | 2196675 | A2 | 6/2010 |
| FR | 660528 | A | 7/1929 |
| FR | 2642479 | A1 | 8/1990 |
| GB | 2111126 | A | 6/1983 |
| GB | 2175956 | | 12/1986 |
| JP | 2009008596 | A | 10/2009 |

OTHER PUBLICATIONS

Written Opinion dated Nov. 4, 2013 for PCT application No. PCT/EP2012/065406.

* cited by examiner

ROOTS PUMP CONNECTION CHANNELS SEPARATING ADJACENT PUMP STAGES

BACKGROUND

1. Field of the Disclosure

The disclosure relates to a Roots pump.

2. Discussion of the Background Art

Roots pumps typically comprise two-toothed rotary pumps arranged in a pump chamber. The two rotary pistons are driven in opposite directions so that the individual chambers formed draw gas through a main inlet and expel the gas through a main outlet. Here, the main inlet and the main outlet both extend in a radial direction and are arranged opposite each other. Further, multi-toothed rotary pistons are known, in particular such pistons with three or four teeth. In this case, too, the gas is pumped substantially radially from a radially arranged main inlet to a radially arranged main outlet.

Further, for producing low pressures, multi-stage Roots pumps are known. Such Roots pumps comprise one pair of rotary pistons per stage. Here, the gas to be pumped is conveyed from one outlet of a pump stage to the inlet of an adjacent pump stage. This is effected through connection channels. As described, for instance, in U.S. 2010/0158728, these connection channels may be arranged in the housing of the Roots pump, wherein the connection channels surround or are arranged radially outside the pump chambers in which the rotary pumps are arranged. This is necessary in order to convey gas from an outlet of a pump stage situated, for instance, in the lower part of the Roots pump to a pump inlet of the adjacent pump stage, which inlet is situated, for instance, in the opposite, upper part of a Roots pump. Such Roots pumps are disadvantageous in that the design of the channels in the housing is technically complex. Further, the housing volume must be large in order to accommodate the connection channels. This does not only result in large outer dimensions of the Roots pump, but in particular entails high costs. Besides the complex manufacturing process, the high costs are due also to the large quantity of metal used.

It is an object of the disclosure to provide a Roots pump of technically simple construction, wherein, further, the necessary structural space and the costs are preferably reduced.

SUMMARY

The Roots pump of the present disclosure comprises a plurality of multi-toothed rotary piston pairs, each forming a pump stage. Per pump stage, two rotary pistons with more than two teeth are provided, it being preferred that the rotary pistons have at least four, in particular at least six teeth. The two rotary pistons of a pump stage rotate in opposite senses to convey the gas. Preferably, one of the two rotary pumps of each rotary pump pair is arranged on a common shaft, so that the Roots pump comprises two shafts extending in parallel, wherein each shaft carries one of the rotary pistons in each stage. The two shafts can be connected through gears so that only one of the shafts has to be driven.

Adjacent pump stages are connected via connection channels. Here, adjacent pump stages may be connected via one or a plurality of connection channels. According to the disclosure, the connection channels are arranged in partitioning walls that separate adjacent pump stages from each other. The partitioning walls are thus provided between the piston chambers of adjacent pump stages. By arranging the connection channels in the partitioning walls, as provided by the disclosure, the outer dimensions of the present Roots pump can be reduced drastically as compared to prior art. This has the advantage that, due to the lower material input, a cost reduction can be achieved. Further, the connection channels provided in the partitioning walls can be manufactured more economically, since it is possible to form the connection channels as straight, in particularly circular cylindrical channels or bores. According to the disclosure, a technically difficult manufacture of curved connection channels situated radially outside the piston chambers is thus not required. The Roots pump, which according to the disclosure is of a very compact structure, has the further advantage that a reduction in weight and a reduction in the number of parts can be achieved. Since they can be designed as dry-running pumps without oil lubrication, Roots pumps further have the advantage that the maintenance requirements are reduced.

It is another advantage of the present arrangement of the connection channels in partitioning walls that less pressure loss is experienced due to the short length of the connection channels.

Preferably, at least a part of the connection channels is connected with the piston chambers, in which the rotary piston pairs are arranged, such that a channel inlet opening and/or a channel outlet opening is swept over by a side wall of a rotary piston in operation. The channel inlet opening and/or the channel outlet opening of at least one connection channel is thus not arranged radially with respect to a piston chamber, but axially. The opening is not swept over by a radial end face, but by a side wall of a rotary piston.

In order to allow for a structure of the present Roots pump that is as compact and as economic as possible, all connection channels are preferably arranged in partitioning walls separating the pump stages from each other. Only one main inlet and/or a main outlet are not arranged in partitioning walls. The main inlet and/or the main outlet may be arranged axially or radially. Preferably the main inlet is arranged radially opposite the main outlet. If, for example, gas is drawn through a main inlet arranged at the top of the pump, the gas is thus expelled, in a preferred embodiment, at the radially opposite bottom of the pump. Of course, the main inlet is radially offset from the main outlet, since the individual pumps are arranged in axial succession, starting from the main inlet to the main outlet.

It is possible, in particular with rotary pistons having three or more teeth, to provide connection channels extending axially in the partitioning walls. This can be realized by the fact that a chamber situated between two teeth does not expel the gas only after a rotation of the rotary pistons by about 180°, but already at a smaller angle of rotation. In such a preferred embodiment of the present Roots pump, the gas does not have to be conveyed between two stages by conveying it from a main inlet-side chamber to a main outlet-side chamber. For example, with three-toothed rotary pistons, gas is drawn through a main inlet at a top of the pump. The gas is conveyed from the first to the second stage through a connection channel arranged centrally at a rotation angle of the rotary pistons of about 90°. This connection channel may extend axially so that the gas enters a central of the adjacent rotary pistons. In this pump stage, the gas is then conveyed further towards the outlet side, from which region it flows into an inlet-side chamber of the adjacent pump stage through a channel arranged in particular obliquely or diagonally in the partitioning wall. In particular with rotary pistons having more than three teeth, multiple axial channels can extend between adjacent pump stages. Providing the axial channels has the particular advantage forming the channels is technically simple. These may be axial, in particular circularly cylindrical bores.

In order to also allow for a technically simple design of the connection channels extending obliquely or diagonally in the partition walls, partitioning walls, in which such connection channels are arranged, are preferably thicker in the axial direction than partitioning walls in which axial connection channels are provided. Thereby, it is possible to also design the oblique connection channels in a straight manner without bends.

In the interest of keeping the power consumption of the pump as low as possible, the connection channels have as large a cross section as possible. In order to increase the cross section it is also possible to provide a plurality of mutually parallel channels. In particular with the channels extending obliquely in the partitioning walls, it should further be observed to make them as short as possible.

For an increase in compression, the rotary pistons preferably have different widths in the axial direction, with the width of the rotary pistons decreasing in particular in a step-like manner in the direction of pumping. Thereby, the volume of the individual chambers formed between the teeth of the rotary pistons is reduced.

In a preferred embodiment, the two meshing rotary pistons have the same diameter and the same shape. However, it is also possible to provide rotary pistons with different diameters and different numbers of teeth, where the rotary pistons will then rotate at different speeds. Likewise, meshing rotary pistons may also have different tooth shapes.

Due to the present design of the Roots pump, it is possible to achieve, in particular, a uniformization of the stress peaks over the rotation of the rotor and, thereby, to also achieve a uniformization of the compression heat.

The following is a detailed description of the disclosure with reference to preferred embodiments and to the accompanying drawings.

DETAILED DESCRIPTION OF THE PREFERRED EMBODIMENT

Figure 1:
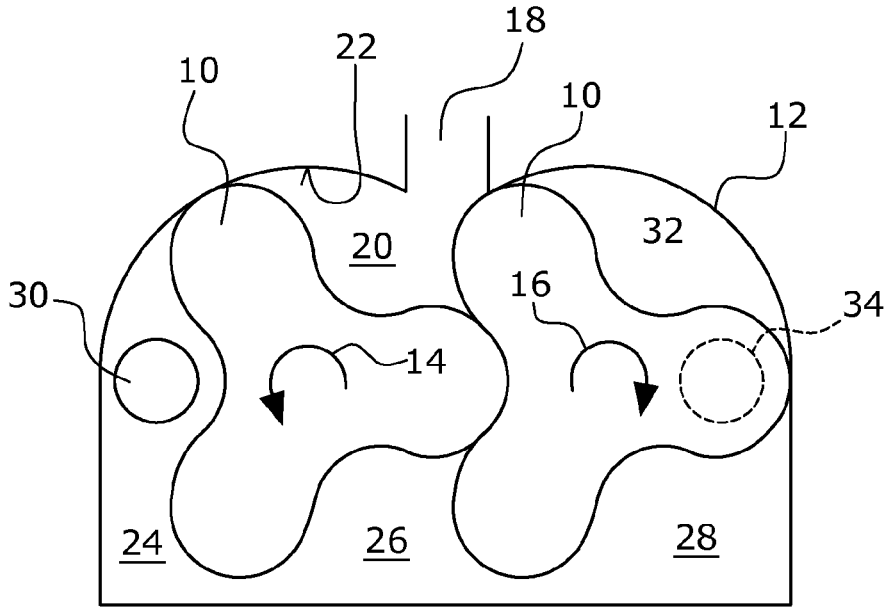
FIG. 1 is a schematic illustration of a three-toothed pressure piston pair of a first pump stage.
Figure 2:
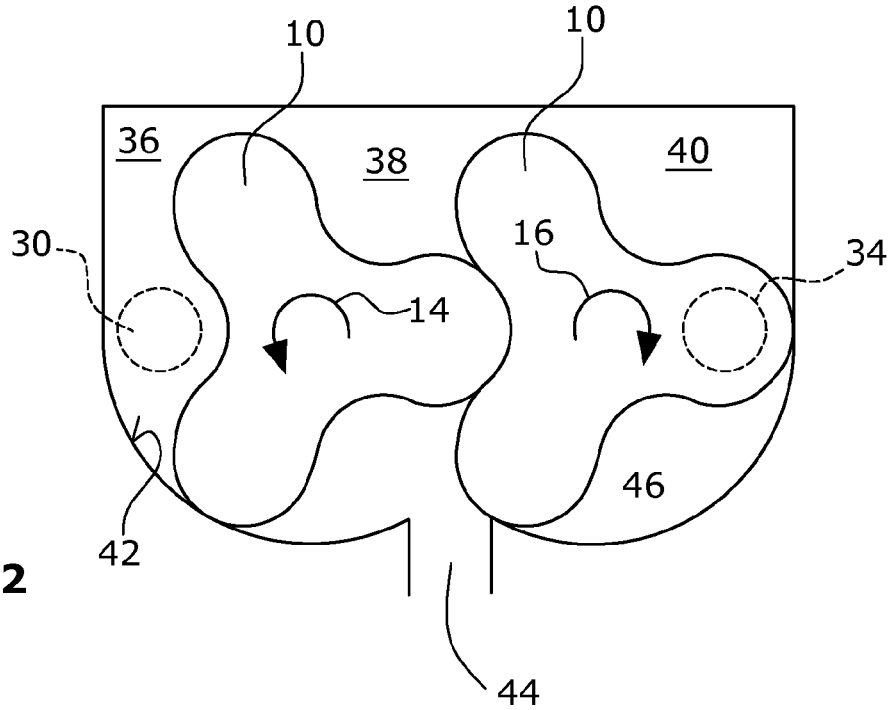
FIG. 2 is a schematic illustration of a three-toothed pressure piston pair of a second, adjacent pump stage.

The three-toothed rotary pistons 10 schematically illustrated in FIGS. 1 and 2 are arranged in a first pump stage (FIG. 1) in a pump chamber 12. The two rotary pistons 10 are each rotatably supported on a non-illustrated shaft and are driven in opposite senses in the direction of the arrows 14 and 16, respectively. Gas is supplied to a chamber 20 via a main inlet 18. By rotation of the left rotary piston in FIG. 1, the gas is enclosed in the chamber 20 that is closed by the curved portion 22 of an outer wall. When the left rotary piston in FIG. 1 is rotated further in the direction of the arrow 14, the chamber 20 is opened in a position corresponding to the chamber identified by the reference numeral 24. The chamber 24 encloses the entire lower portion of the two rotary pistons so that the portions 24, 26, 28 have the same pressure level. Thereby, the gas initially in chamber 20 is expelled through an axial connection channel 30, i.e. a channel extending in parallel with the rotary shafts of the rotary pistons.

Likewise, the right rotary piston in FIG. 1 encloses gas in a chamber 32, which is moved downward in the direction of the arrow 16 in FIG. 1 by rotation of the rotary piston 10, and is then expelled through the also axially extending connection channel 34 illustrated in dotted lines.

In the next pump stage (FIG. 2), which is arranged axially downstream with respect to the first pump stage (FIG. 1), gas enters a chamber 36 through the connection channel 30, the chamber being at the same pressure level as the portions 38, 40. By rotating the left rotary piston in FIG. 2, a chamber, closed in itself, is formed in combination with the curved wall 42 so that the gas enclosed therein is supplied towards a main outlet 44. The same principle of conveyance is implemented by the right rotary piston in FIG. 2, where gas enters the chamber 40 through the connection channel 34 as soon as the right piston 10 is rotated on in the direction of the arrow. The gas then enclosed in a chamber 46 is also conveyed towards the main outlet 44.

In order to form a third stage, the gas again has to be conveyed from the outlet 44, which is the main outlet in FIG. 2, upwards towards a main inlet. According to the disclosure, this is effected by means of channels extending diagonally or obliquely in a partitioning wall, which channels are not illustrated in this embodiment.

Figure 3:
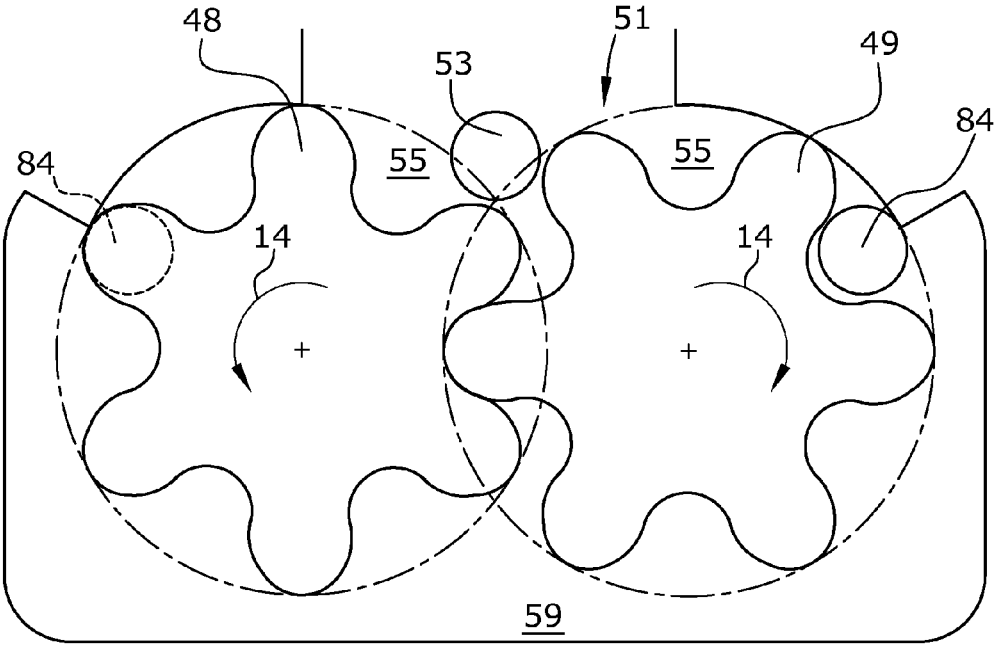
FIG. 3 is a schematic illustration of a six-toothed rotary piston pair of a first stage.
Figure 4:
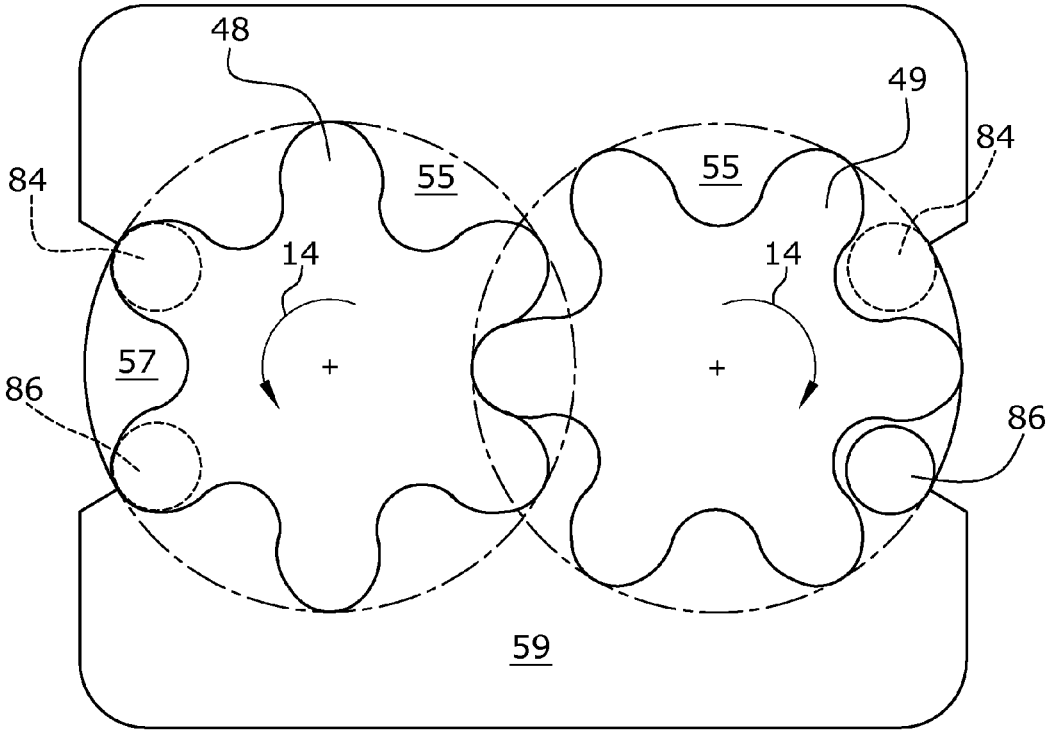
FIG. 4 is a schematic illustration of a six-toothed rotary piston pair of a second stage.
Figure 5:
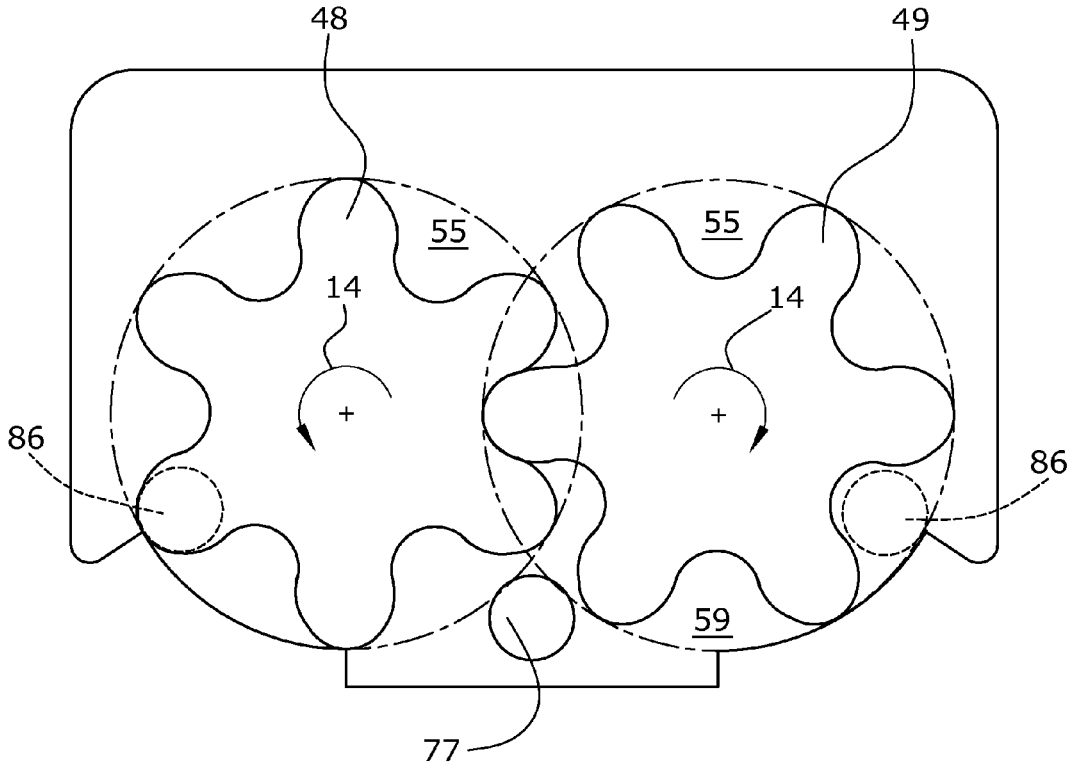
FIG. 5 is a schematic illustration of a six-toothed rotary piston pair of a third stage.
Figure 6:
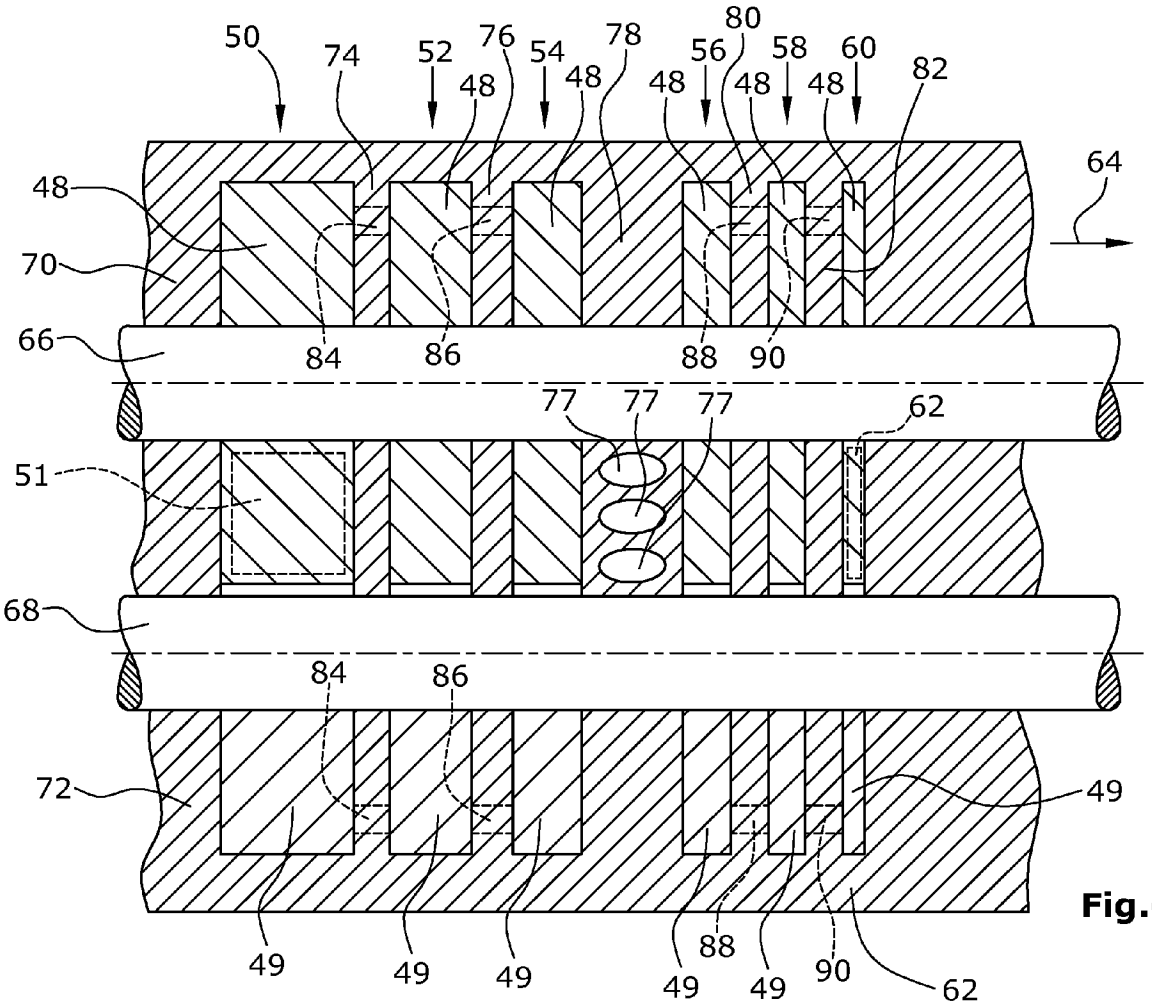
FIG. 6 is a schematic sectional view of a six-stage Roots pump comprising six-toothed rotary pistons as schematically illustrated in FIGS. 3-5.

FIGS. 3-5 illustrate six-toothed rotary piston pairs 48, 49 together with the connection channels relevant to a first stage (FIG. 3), a second stage (FIG. 4) and a third stage (FIG. 5). In a Roots pump with six stages (FIG. 6), for example, the illustration in FIG. 3 corresponds to a first stage 50, the illustration in FIG. 4 corresponds to a second stage 52, and the illustration in FIG. 5 corresponds to a third stage 54. The fourth stage 56 essentially corresponds to the first stage (FIG. 3), where the inlet, however, does not occur radially but through an obliquely or diagonally extending connection channel 77. The fifth stage 58 corresponds to the second stage or FIG. 4, and the sixth stage 60 corresponds to the third stage 54 or the stage illustrated in FIG. 5, with the outlet occurring in the radial direction through a main outlet 62. The individual rotary pistons 48, whose width decreases in the axial direction or the pumping direction 64, are supported on a common shaft 66. Likewise, the rotary pistons 49 are supported on a common shaft 68. The two shafts 66, 68 are rotatably supported in an upper housing half 70 or a lower housing half 72 and can be connected via non-illustrated gears so that only one of the two shafts 66, 68 has to be driven by a motor.

Partitioning walls 74, 76, 78, 80, 82 are provided between adjacent pump stages. In the embodiment illustrated, at least one connection channel 84, 86, 88, 90, 77 is arranged. In addition, it is also possible to provide connection channels that are at least partly arranged in an outer portion, as known from prior art. In the embodiment illustrated, gas is drawn through the main inlet 51. Instead of a radially arranged main inlet 51, the same may also be formed radially as an inlet 53 (FIG. 3). Of course, it is also possible to provide an oblique inlet or even a combination of different inlets, where the inlet only has to provide a means for the inflow of gas into the chamber 55 (FIG. 3).

Thereafter, the gas is conveyed from the first pump stage 50 into the second pump stage 52 through a connection channel 84 extending axially, i.e. in parallel with the shafts 66, 68. The connection channel 84 is arranged in the partitioning wall 74. Here, according to the principle described for FIGS. 1 and 2, the gas is conveyed into a chamber 59 connected with the connection channels 84 via the intermediate chamber.

The gas is then conveyed further (FIG. 4) and flows from the second pump stage 52 into the third pump stage 54 through a connection channel 86 also extending axially. The connection channel 86 is arranged in the partitioning wall 76.

When the gas is conveyed further (FIG. 5), it is necessary to convey the gas from the main outlet side towards the main inlet side. For this purpose, a diagonal or oblique channel 77 is provided in the partitioning wall 78 which is thicker in the axial direction than the other partitioning walls 74, 76, 80, 82.

The gas is conveyed from the fourth pump stage 56 into the fifth pump stage 58 through a channel 88 extending axially in the partitioning wall 80. The conveyance into the next pump stage 60 again occurs through an axial channel 90 provided in the partitioning wall 82. Since, in the embodiment illustrated, the sixth pump stage 60 is the last pump stage, the same s connected with the substantially radial main outlet 62.

Since, as is obvious in particular from FIGS. 3-5, only a part of the chambers is used to convey gas, the chambers, in which the rotary pistons are arranged, require a surface finishing with small tolerance levels only in the region of the active chambers, i.e. the chambers relevant to conveying. Thereby, manufacturing costs can be reduced further.

Figure 7:
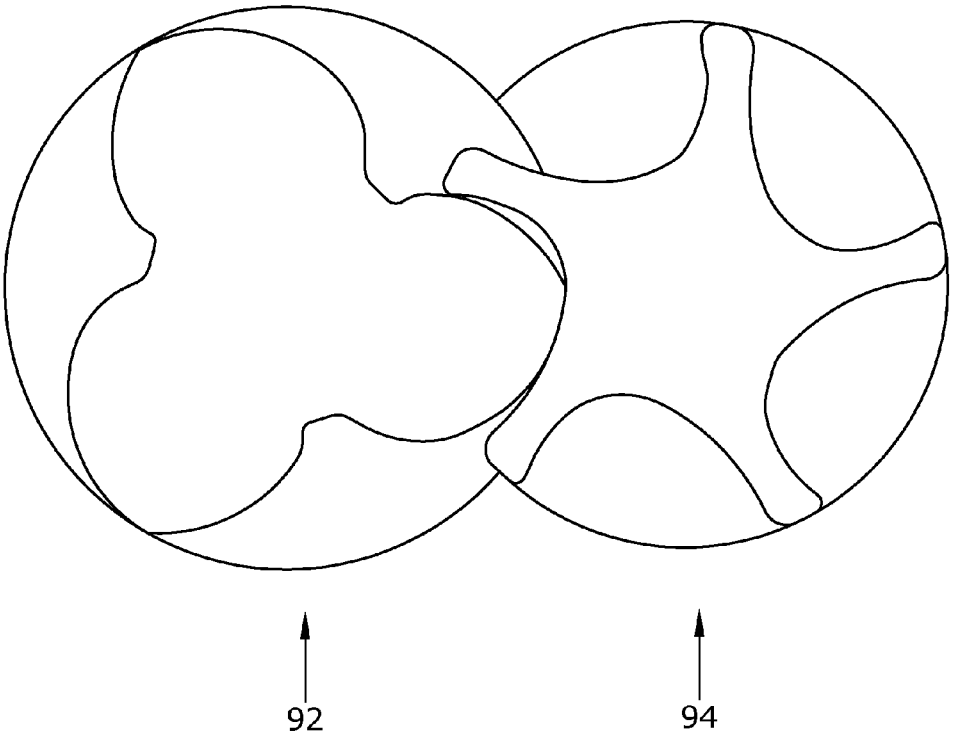
FIG. 7 is a schematic top plan view on an alternative embodiment of a rotary piston pair.

Instead of identically designed rotary pistons, it is also possible to provide rotary pistons with different diameters and in particular different numbers of teeth. Moreover, a combination of rotary pistons having different tooth shapes is possible. An example is illustrated in FIG. 7 in top plan view. Here, a left rotary piston 92 has teeth that cooperate with five differently shaped teeth of a right rotary piston 94.

The invention claimed is:

1. A Roots pump comprising:

a plurality of multi-toothed rotary pumps, each forming a Roots-type pump stage, and connection channels connecting respective adjacent Roots-type pump stages, wherein the connection channels are arranged in partitioning walls separating the adjacent Roots-type pump stages, and wherein said multi-toothed rotary pistons comprises at least 3 teeth and at least some of the connection channels extend only axially between the adjacent Roots-type pump stages.

2. The Roots pump of claim 1, further comprising, in operation, a channel inlet opening and/or a channel outlet opening of at least one connection channel is swept over by a side wall of a rotary piston.

3. The Roots pump of claim 1, wherein all said connection channels are arranged in said partitioning walls separating the Roots-type pump stages.

4. The Roots pump of claim 1, further comprising a main inlet arranged radially opposite a main outlet.

5. The Roots pump of claim 4, wherein at least one said connection channel that connects said Roots-type pump stage with said adjacent Roots-type pump stage extends obliquely in the corresponding partitioning wall and transversely to the plane formed by the two shaft axes.

6. The Roots pump of claim 5, wherein said partitioning walls including oblique connection channels are thicker than said partitioning walls including axial connection channels.

7. The Roots pump of claim 1, wherein one of the two rotary pistons of each rotary piston pair is arranged on a common shaft.

8. The Roots pump of claim 1, wherein the axial width of the rotary pistons of individual Roots-type pump stages decreases in particular in the pumping direction.

9. A Roots pump comprising:

a plurality of rotary pumps forming a Roots-type pump stage, each rotary pump comprising at least 3 teeth;

a partitioning wall separating a first Roots-type pump stage from a second Roots-type pump stage; and a connection channel defined through the partitioning wall so as to connect the first Roots-type pump stage to the second Roots-type pump stage, the connection channel consisting of a straight cylindrical bore between the first and second Roots-type pump stages.

10. A Roots pump comprising:

a plurality of rotary pumps forming a Roots-type pump stage, each rotary pump comprising at least 3 teeth;

a partitioning wall separating adjacent Roots-type pump stages; and a connection channel defined through the partitioning wall so as to connect the adjacent Roots-type pump stages, wherein the Roots-type pump stage and connection channel are configured to expel gas only after a rotation of the rotary pumps by an angle of rotation of less than 180°.

* * * * *